US005146387A

United States Patent [19]

Itoh et al.

[11] Patent Number: 5,146,387

[45] Date of Patent: Sep. 8, 1992

[54] INTERRUPTER HAVING GROUNDED INTERRUPTER CONTAINER WITHIN A GROUNDED COVER

[75] Inventors: Syunji Itoh; Takahide Seki; Haruo Honda, all of Hitachi, Japan

[73] Assignee: Hitachi, Ltd., Tokyo, Japan

[21] Appl. No.: 507,510

[22] Filed: Apr. 11, 1990

[30] Foreign Application Priority Data

Apr. 24, 1989 [JP] Japan ..... 1-101715

[51] Int. Cl.[5] ..... H01H 73/06; H01H 9/02; H01H 13/04

[52] U.S. Cl. ..... 361/115; 200/148 B; 335/202; 361/160

[58] Field of Search ..... 361/115, 160; 200/148 B; 335/202

[56] References Cited

U.S. PATENT DOCUMENTS

| | | | |
|---|---|---|---|
| 3,727,019 | 4/1973 | Harvey | 200/144 B |
| 3,813,507 | 5/1974 | Kesselring | 200/148 A |
| 4,514,783 | 4/1985 | Olsen et al. | 361/336 |
| 4,663,504 | 5/1987 | Barkan | 200/148 B |
| 4,849,650 | 7/1989 | Lutz | 200/148 B |
| 4,860,157 | 8/1989 | Russel | 361/456 |
| 4,894,631 | 1/1990 | Castonguay et al. | 335/167 |
| 4,913,503 | 4/1990 | Castonguay et al. | 335/172 |
| 5,023,415 | 6/1991 | Itoh et al. | 200/148 R |

*Primary Examiner*—A. D. Pellinen
*Assistant Examiner*—Richard T. Elms
*Attorney, Agent, or Firm*—Antonelli, Terry Stout & Kraus

[57] ABSTRACT

An interrupter unit comprising, an interrupter including at least two pairs of contacts, and an interrupter container surrounding the pairs of contacts, each of the pairs of contacts having a first contact and a second contact which contacts the first contact or is positioned away from the first contact so that electricity flows between the first contact and the second contact or is prevented from flowing between the first contact and the second contact, an electric actuator device for driving the pairs of contacts so that the second contacts contact the first contacts or are positioned away from the first contacts, and at least one voltage-transformer which transforms an input voltage and supplies a suitably transformed voltage to the electric actuator device so that the electric actuator device drives the pairs of contacts, wherein the interrupter unit further comprises an electrically grounded cover surrounding the interrupter and having first cover terminals which are electrically connected to the first contacts, respectively, and second cover terminals which are electrically connected to the second contacts, respectively, wherein, the electric actuator device and the voltage-transformer are located in a space formed between the electrically grounded cover and the interrupter, the voltage-transformer being electrically connected to at least one of the cover terminals of the electrically grounded cover to receive the input voltage. Therefore, the inventive interrupter unit may be smaller than a prior art interrupter unit, while maintaining the safe condition of the interrupter unit.

5 Claims, 6 Drawing Sheets

INTERRUPTER HAVING GROUNDED INTERRUPTER CONTAINER WITHIN A GROUNDED COVER

BACKGROUND OF THE INVENTION AND RELATED ART STATEMENT

The present invention relates to an electric interrupter with at least one voltage-transformer, more particularly to an electric interrupter which has an electric actuator for actuating the interrupter and has at least one voltage-transformer for supplying suitable voltage to the electric actuator.

FIG. 4 on page 8 (198) of "Mitsubishi-denki-gihou" Vol. 62, No. 3, 1988, shows an electric circuit of an electric interrupter including two voltage-transformers for supplying suitable voltage to an interface device communicating with a not-shown main controller, in which interrupter an input terminal of each of the voltage-transformers is connected to one of terminals of the interrupter and an output terminal of each of the voltage-transformers is connected to the interface device. And FIG. 33 on page 1240 of "Denki-kougaku-handbook" published in 1988 shows a unit including a voltage-transformer and an electric interrupter which interrupts electric current supplied to the voltage-transformer and which is actuated by a lever extending to the outside of the unit.

Page 104 in "Yasukawa-denki" Vol. 47, Issue 179, No. 2 shows another kind of interrupter including a plurality of pairs of contacts each pair of which is driven by an operating mechanism to interrupt or transmit electric current, and a container receiving the pairs of contacts. Both horizontal sides of the container have respective sets of insulators between which the pairs of contacts are operated to interrupt or transmit the electric current supplied through the insulators. The pairs of contacts are received by respective insulating molded members. The operating mechanism has a spring mechanism a potential energy of which drives the pairs of contacts to interrupt the electric current, and an electromagnetic driving mechanism which drives the pairs of contacts to transmit the electric current and drives the spring mechanism to be given the potential energy thereof. Japanese utility model laid-open publication No. 60-112043 and Japanese patent laid-open publication No. 61-99226 disclose another kind of interrupter whose structure is similar to the above described structure but does not include the above described insulating molded members.

In the conventional interrupter as described above, since the electromagnetic driving mechanism drives the pairs of contacts to transmit the electric current and drives the spring mechanism to be given the potential energy thereof, in order that the electromagnetic driving mechanism can generate sufficient power for driving the pairs of contacts and the spring mechanism, it is necessary that a large current is supplied to an electromagnetic coil of the electromagnetic driving mechanism or that a number of turns of the electromagnetic coil is large. When the number of turns of the electromagnetic coil is large, a size of the electromagnetic coil is large. When the large current is supplied to the electromagnetic coil, a size of the transformer for supplying electric current to the electromganetic coil is large.

Further, in the prior art, since the transformer for supplying electric current from the interrupter to an interrupter-controller is arranged away from the interrupter and is connected to the interrupter by an electric cable having a long length to keep a perfect insulating condition between the transformer and the interrupter, an interrupter unit of the prior art including the transformer, the electric cable and the interrupter with the interrupter-controller has a large size.

OBJECT AND SUMMARY OF THE INVENTION

An object of the present invention is to provide an interrupter unit including an interrupter, an electric actuator for driving the interrupter, and at least one voltage-transformer for supplying a suitably transformed voltage to the electric actuator, whose size is smaller than a size of the prior art interrupter unit described above, and which maintains a safe condition of the interrupter unit.

An interrupter unit according to the present invention, comprising, an interrupter including at least two pairs of contacts and an interrupter container surrounding the pairs of contacts and prevented from electrically communicating with the pairs of contacts, each of the pairs of contacts having a first contact and a second contact which contacts the first contact or is positioned away from the first contact so that electricity flows between the first contact and the second contact or is prevented from flowing between the first contact and the second contact, electric actuator means for driving the pairs of contacts so that the second contacts contact the first contacts or are positioned away from the first contacts, and at least one voltage-transformer which transforms an input voltage and supplies a suitably transformed voltage to the electric actuator means so that the electric actuator means drives the pairs of contacts, wherein the interrupter unit further comprises, an electrically grounded cover surrounding the interrupter and having first cover terminals which are electrically connected to the first contacts respectively and which are prevented from electrically communicating with the grounded cover, and second cover terminals which are electrically connected to the second contacts respectively and which are prevented from electrically communicating with the grounded cover, the electric actuator means and the voltage-transformer are located in a space formed between the electrically grounded cover and the interrupter, the voltage-transformer is electrically connected to the cover terminals in the electrically grounded cover to input the electricity.

In the interrupter unit according to the present invention, since the interrupter unit further comprises the electrically grounded cover surrounding the interrupter and having the first cover terminals which are electrically connected to the first contacts respectively and which are prevented from electrically communicating with the electrically grounded cover, and the second cover terminals which are electrically connected to the second contacts respectively and which are prevented from electrically communicating with the electrically grounded cover, the electric actuator means and the voltage-transformer are located in the space formed between the electrically grounded cover and the interrupter, and the voltage-transformer is electrically connected to the cover terminals in the electrically grounded cover, it is difficult for an electrically conductive substance to arrive in the electrically grounded cover from the outside of the interrupter unit to destroy at least one electric insulation in the electric actuator means, the voltage-transformer and/or the interrupter, and/or between the electrically grounded cover and the interrupter, between the interrupter and the voltage-transformer, between the electrically grounded cover and the voltage-transformer, between the voltage-transformer and the electric actuator means and/or between the electrically grounded cover and the electric actuator means, and further even if the electric insulation is destroyed therebetween by the electrically conductive substance or by aerial discharge, and/or even if insulating strength of any of their own structures decreases or is low and the electric insulation is destroyed in any of their own structures, the electrically grounded cover prevents the voltage at the electrically grounded cover from increasing more than the voltage of the ground, so that distances between the electrically grounded cover and the interrupter, between the interrupter and the voltage-transformer, between the electrically grounded cover and the voltage-transformer, between the voltage-transformer and the electric actuator means and between the electrically grounded cover and the electric actuator means may be small while maintaining the electric insulation therebetween or while maintaining a safe condition of the interrupter unit, more particularly with maintaining the safety of people outside of the interrupter unit, and the voltage-transformer, the electric actuator means and the interrupter may have respective small-insulating-strength structures while maintaining the safe condition of the interrupter unit. Therefore, the size of the interrupter unit according to the present invention may be smaller than a size of the prior art interrupter unit, while maintaining the safe condition of the interrupter unit.

DETAILED DESCRIPTION OF THE PREFERRED EMBODIMENTS

Figure 1:
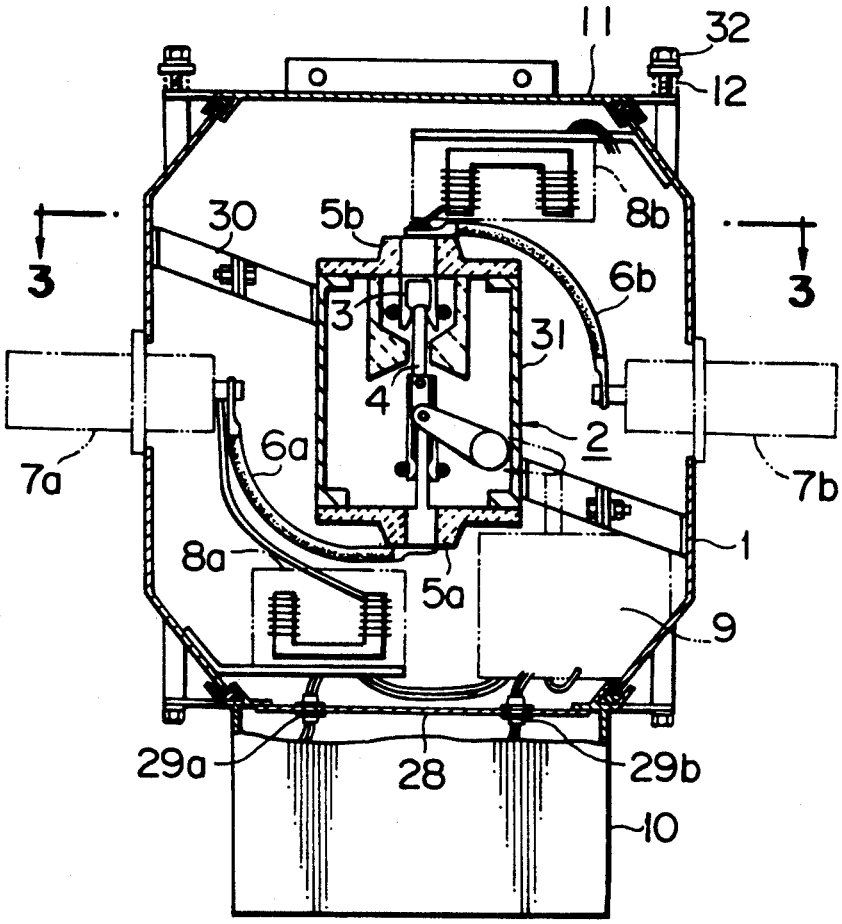
FIG. 1 is a partial cross-sectional view showing an embodiment of an interrupter unit according to the present invention showing the electrically grounded cover surrounding the electric actuator, voltage-transformer and the electrically grounded interrupter container surrounding the contact pair.
Figure 3:
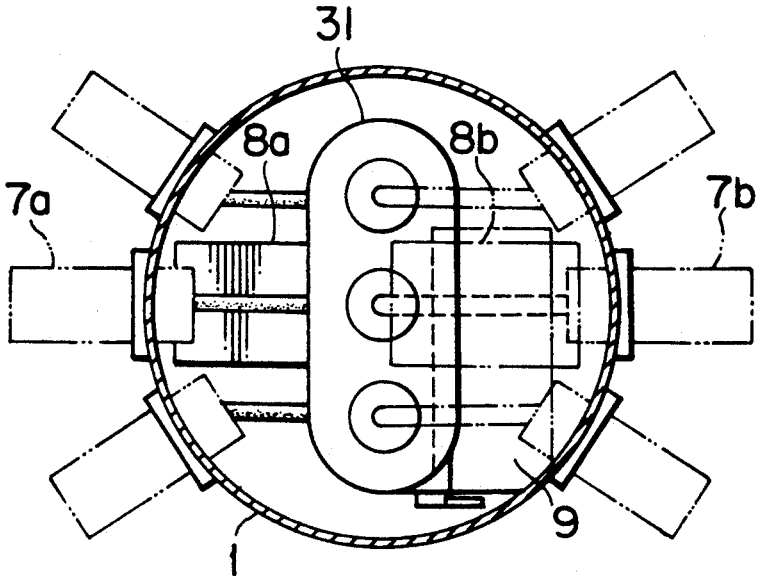
FIG. 3 is a cross-sectional view taken along line 3—3 of the interrupter unit shown in FIG. 1.

In FIGS. 1 and 3 showing an embodiment of interrupter unit according to the present invention, an electrically grounded cover 1 surrounds an interrupter 2 which is fixed in the electrically grounded cover 1 by support members 30 made of metal. The interrupter 2 has a container 31 made of metal, a pair of insulating bushings 5*a* and 5*b* made of ceramic, and three pairs of contacts 3, 4. The interrupter insulating bushings 5*a* and 5*b* close over respective longitudinal open ends of the container 31. Each of the pairs of contacts 3, 4 has a fixed contact 3 and a movable contact 4 which is moved vertically to contact the fixed contact 3 or to be positioned away from the fixed contact 3 through a link mechanism by an actuator device 9 arranged between the interrupter 2 and the electrically grounded cover 1, so that the interrupter 2 is operated to transmit or interrupt electricity. The actuator device 9 is preferably an electromagnetic solenoid surrounded by a metal cover. On the other hand, the actuator device 9 may be a linear motor or a linear actuator including an electric rotational motor and a screw-nut unit converting rotation of the electric motor into a linear movement of the screw or of the nut. The metal support members 30 extend between the container 31 and the electrically grounded cover 1 so that the metal container 31 is also electrically grounded through the support members 30. The contacts 3 and 4 extend through the insulating bushings 5*a* and 5*b* to the outside of the interrupter 2 respectively and are electrically connected through respective insulation-coated lines 6*a* and 6*b* to respective cover bushings 7*a* and 7*b* through which electrically conductive bars connected respectively to the insulation-coated lines 6*a* and 6*b* extend to the outside of the electrically grounded cover 1 to input the electricity and which are arranged horizontally. The three pairs of contacts 3, 4 are arranged on a straight line and each of two insulating walls is arranged between the adjacent two pairs of contacts 3, 4. Three kind of gases different from each other may be inserted into respective interrupter chambers defined by the insulating walls, the container 31 and the interrupter insulating bushings 5*a* and 5*b*. An upper portion of the electrically grounded cover 1 is covered by an upper cover 11 which is pressed against the electrically grounded cover 1 by bolts 32 and pressure-discharge springs 12 arranged between the bolts 32 and the upper cover 11 so that the upper cover 11 is opened at a predetermined pressure inside of the electrically grounded cover 1. A lower portion of the electrically grounded cover 1 is covered by an electromagnetic-noise shield plate 28 beneath which a branch controller 10 is arranged for operating and driving the actuator device 9 in accordance with signals outputted by a main controller (not shown).

Figure 2:
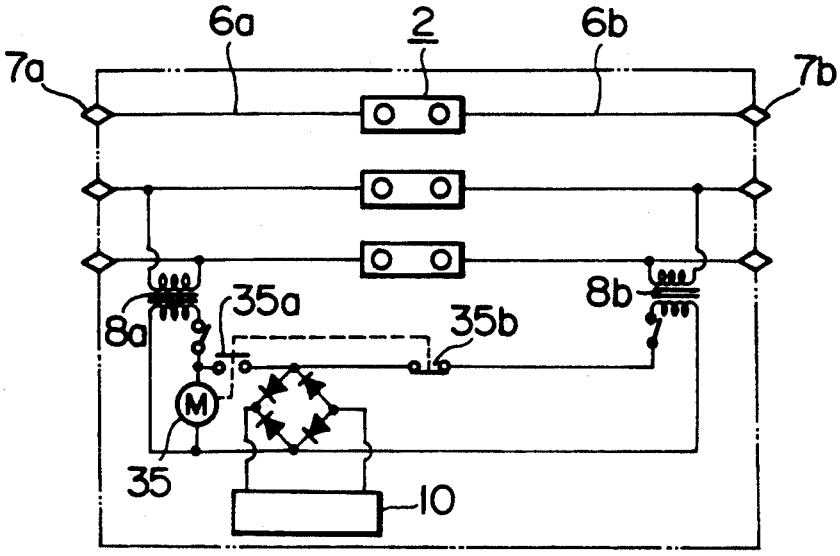
FIG. 2 is a diagram showing an electric circuit used in the interrupter unit shown in FIG. 1.

Voltage-transformers 8*a* and 8*b* are arranged between the electrically grounded cover 1 and the interrupter 2. As shown in FIG. 2, an input coil of each of the voltage-transformers 8*a* and 8*b* is electrically connected to two phases of three-phases-alternating-current (A.C.) through the cover bushings 7*a* or 7*b*, or through the contacts 3 or 4, or through the insulation-coated lines 6*a* or 6*b* connecting electrically the cover bushings 7*a* or 7*b* to the contacts 3 or 4. And an output coil of each of the voltage-transformers 8*a* and 8*b* is electrically connected to the branch controller 10 through connectors 29*a* and 29*b* mounted on the electro-magnetic-noise shield plate 28 and through a rectifier circuit so that a suitably transformed voltage is supplied to the branch controller 10. When the voltage-transformer 8*a* is energized and a relay 35 is energized, a contact 35*a* is moved to let the electricity flow and a contact 35*b* is moved to prevent the electricity from flowing. And when the voltage-transformer 8*a* is not energized and the relay 35 is not energized, the contact 35*a* is moved to prevent the electricity from flowing and the contact 35*b* is moved to let the electricity flow. Therefore, the electricity is supplied to the branch controller 10 and the actuator device 9 from one of the voltage-transformers 8*a* and 8*b*. The actuator device 9 is electrically connected to the branch controller 10 by an insulation-coated wire and the branch controller 10 is connected to the main controller by another insulation-coated wire. But these insulation-coated wires are not shown in the drawings.

Figure 8:
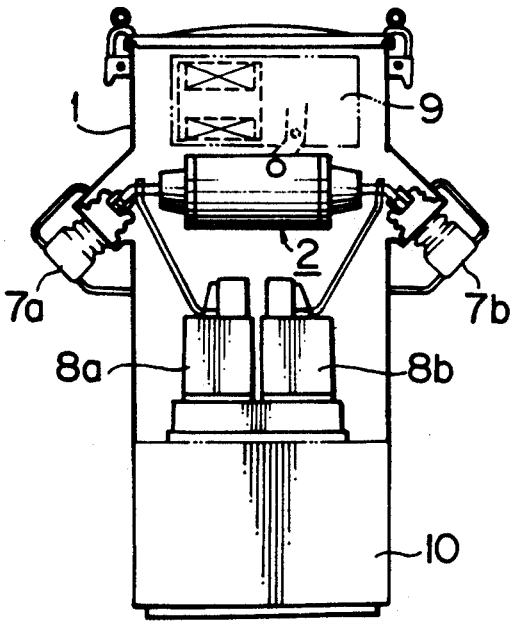
FIGS. 8 and 9 are a partial cross-sectional view of the interrupter unit of the present invention showing various locations for the actuator and voltage-transformers.
Figure 9:
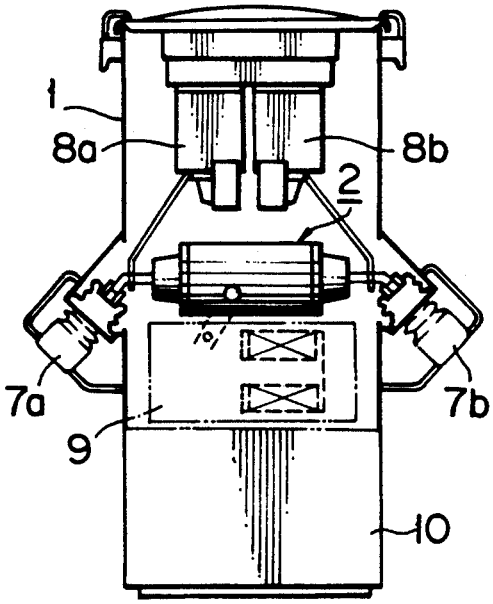

As shown in FIGS. 1, 8 and 9, the electric actuator device 9 and the voltage-transformers 8*a* and 8*b* are located in the space formed between the electrically grounded cover 1 and the interrupter 2, and the voltage-transformers 8*a* and 8*b* are electrically connected to the cover bushing terminals 7*a* and 7*b* or to the contacts 3 and 4, or to the insulation-coated lines 6*a* and 6*b* whose insulations coatings are removed at points connected electrically to the voltage-transformers 8*a* and 8*b*, respectively, in the electrically grounded cover 1.

Figure 4:
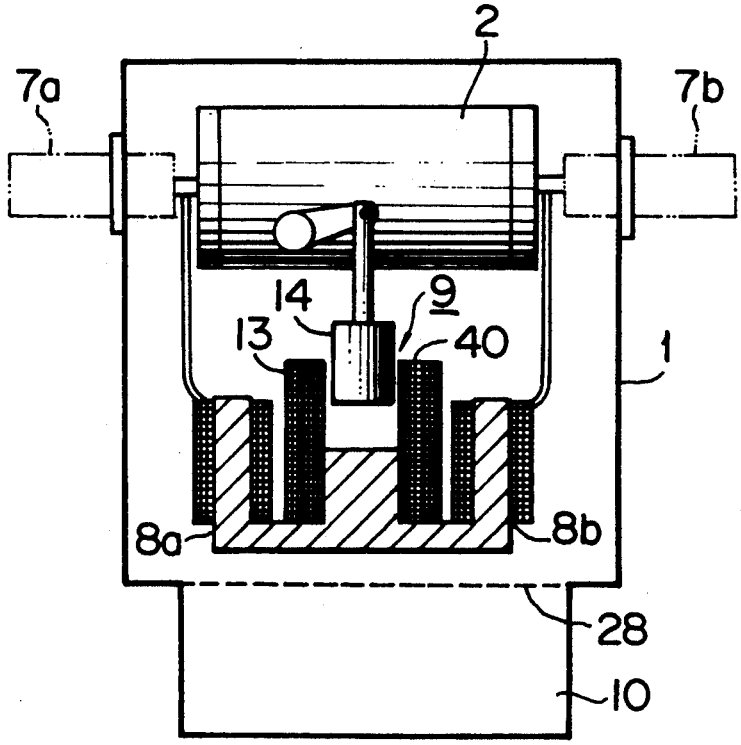
FIG. 4 is a partial cross-sectional view showing another embodiment of an interrupter unit according to the present invention wherein the voltage-transformers are integrally formed with the actuator and both the longitudinal axis of the interrupter and the direction of contact movement are horizontal.

As shown in FIG. 4, the voltage-transformers 8*a* and 8*b* may be formed integrally with the actuator device 9. The interrupter 2 is arranged between the cover bushing terminals 7*a* and 7*b* in the electrically grounded cover 1 and a longitudinal axis of the interrupter 2 is arranged horizontally. The movable contact 4 (not shown in FIG. 4) is moved also horizontally. The actuator device 9 for moving the movable contact 4 includes a plunger 14 mechanically connected to the movable contact 4, an electromagnetic coil 13 and a spring mechanism (not shown). The electromagnetic coil 13 surrounds an electromagnetic coil 40 which cooperates with the voltage-transformers 8*a* and 8*b* to output the transformed voltage. The output voltage of the electromagnetic coil 40 is supplied to the electromagnetic coil 13 through a rectifier circuit and a switch (not shown) which is operated to let the electricity flow when the interrupter 2 is operated. Since the voltage-transformers 8*a* and 8*b* are formed integrally with the actuator device 9, a size of the interrupter unit may be smaller in comparison with the before-mentioned interrupter unit.

Figure 5:
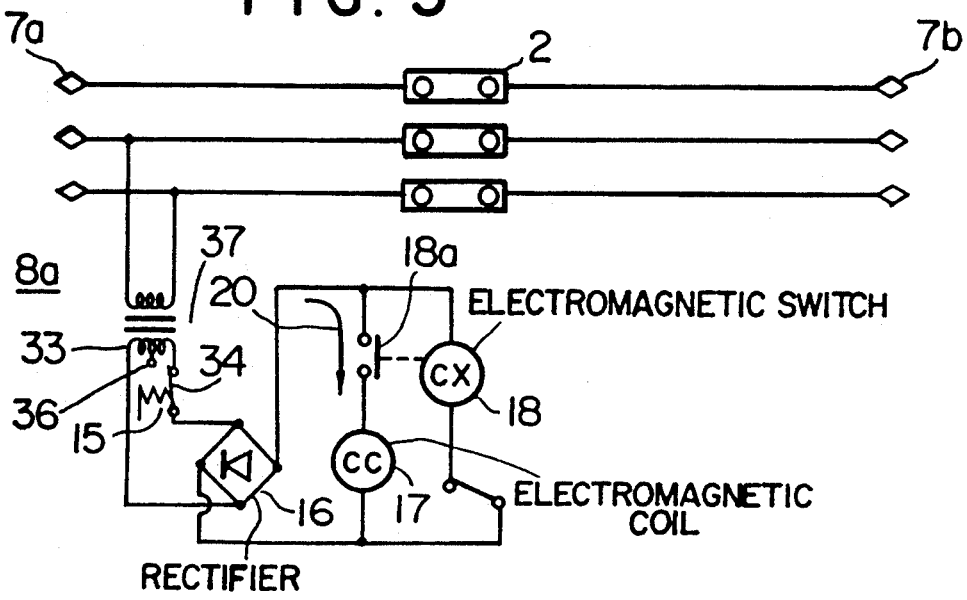
FIG. 5 is a diagram showing an electric circuit used in the other embodiment of the interrupter unit according to the present invention wherein a movable contact changes the voltage-transformer output responsive to temperature.

Another electric circuit used in the interrupter unit is shown in FIG. 5. Since a tap 36 is arranged in an output coil 33 of the voltage-transformer 8*a* and a contact 34 is moved between the tap 36 and an end 37 of the coil 33 so that a number of energized turns in the output coil 33 can be changed, the output transformed voltage of the voltage-transformer 8*a* is changed. The contact 34 is moved to the tap 36 to decrease the output transformed voltage by a shape-memory alloy 15 which contracts with an increase of shape-memory alloy temperature caused by a continuous flow of the coil current 20 when something goes wrong with a contact 18*a* such as melting and so forth. Therefore, the rectifier 16 is prevented from overheating. The coil 33 is connected through a rectifier 16 to an operating electromagnetic coil 17 and an electromagnetic switch 18 arranged in parallel with the operating electro-magnetic coil 17 and the rectifier 16 in series.

Figure 6:
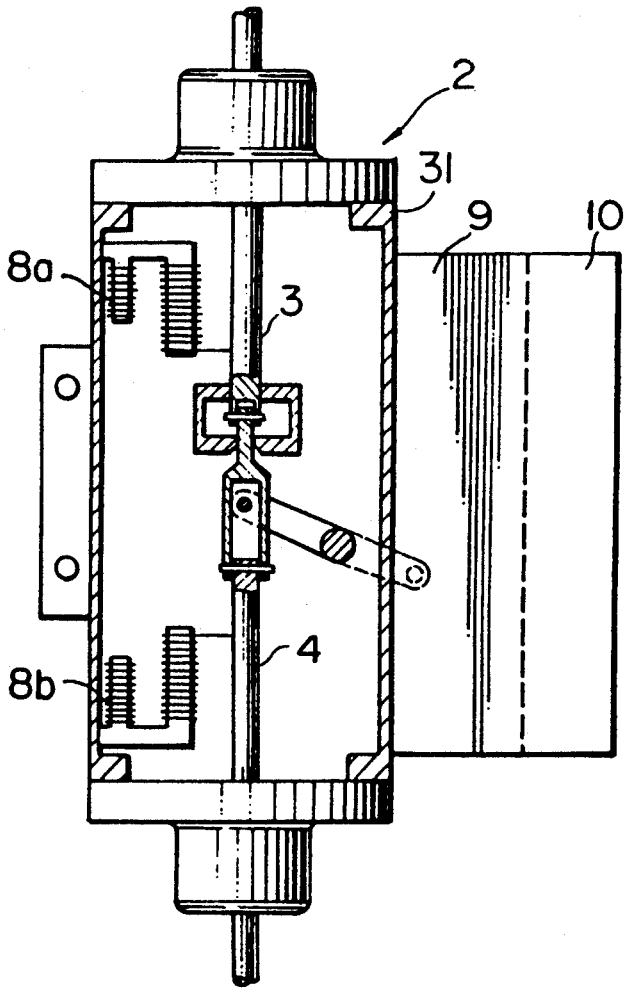
FIG. 6 is a partial cross-sectional view showing another embodiment of the interrupter unit of the present invention wherein the contacts, voltage-transformers and electric actuator form a more compact arrangement within the grounded container.

In an embodiment shown in FIG. 6, the voltage-transformers 8*a* and 8*b* are arranged between the container 31 and the pairs of contacts 3, 4 in the container 31 of the interrupter 2, the container 31 is electrically grounded, and the actuator device 9 and the branch controller 10 are mounted on the container 31. The electrically grounded container 31 surrounds the pairs of contacts 3, 4 which are prevented by the ceramic bushings from electrically communicating with the electrically grounded container 31. Since the voltage-transformers 8*a* and 8*b* are arranged in the container 31 which is grounded electrically, even if the insulating strength of any of their own structures decreases or is low and the electric insulation is destroyed in any of their own structures, the container 31 which is grounded electrically prevents the voltage at the container 31 from increasing more than the voltage of the ground, so that distances between the container 31 and the pairs of the contacts 3 and 4, between the pairs of the contacts 3 and 4 and the voltage-transformers 8*a* and 8*b*, between the container 31 and the voltage-transformers 8*a* and 8*b*, and between the pairs of the contacts 3 and 4 and the electric actuator device 9 may be small while maintaining the electric insulation therebetween or while maintaining a safe condition of the interrupter unit, more particularly while maintaining the safety of people outside of the interrupter unit, and the voltage-transformers 8*a* and 8*b* and the electric actuator device 9 may have respective small-insulating-strength structures while maintaining the safe condition of the interrupter unit. Therefore, the size of the interrupter unit according to this embodiment may be small while maintaining the safe condition of the interrupter unit.

Figure 7:
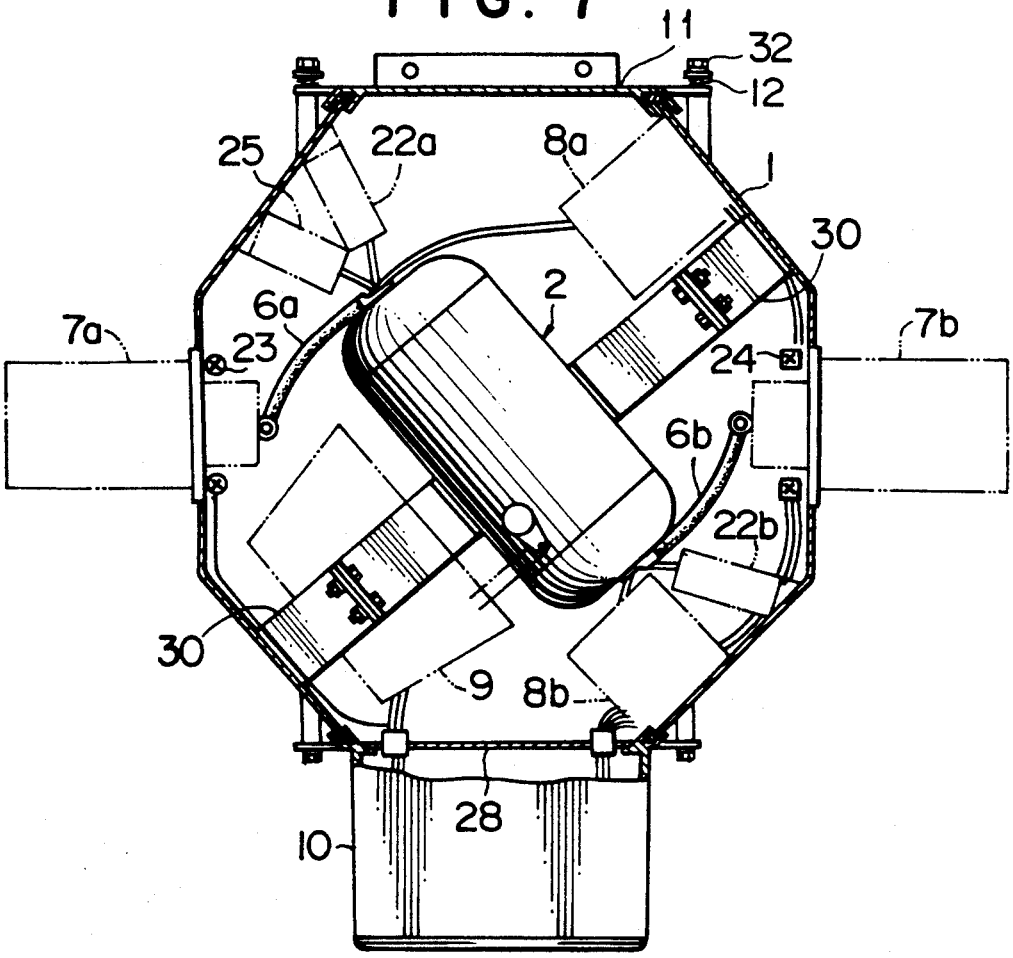
FIG. 7 is a partial cross-sectional view of the interrupter unit of the present invention showing the location of the voltage and excess current detectors.

In FIG. 7 showing another embodiment of interrupter unit according to the present invention, the electrically grounded cover 1 surrounds the interrupter 2 which is fixed in the electrically grounded cover 1 by support members 30 made of metal. The contacts 3 and 4 extend through the insulating bushings 5*a* and 5*b* to the outside of the interrupter 2 respectively and are electrically connected through respective insulation-coated lines 6*a* and 6*b* to respective cover bushings 7*a* and 7*b* through which electrically-conductive bars connected respectively to the insulation coated lines 6*a* and 6*b* extend to the outside of the electrically grounded cover 1. The voltage-transformers 8*a* and 8*b* and lighting arresters 22*a* and 22*b* are electrically connected to the contacts 3 and 4, respectively. Voltage-detectors 25 are electrically connected to the fixed contacts 3 or the movable contacts 4. Excess-current detectors 23 surround the cover bushings 7*a*. Zero-current detectors 24 surround the cover bushings 7*b*. The electrically grounded cover 1 is covered by an upper cover 11 which is pressed against the electrically grounded cover 1 by bolts 32 and pressure-discharge springs 12 arranged between the bolts 32 and the upper cover 11 so that the pressure-discharge springs 12 are contracted and the upper cover 11 is opened when the pressure inside of the cover 1 is increased by a short-circuit. The electrically grounded cover 1 is covered by an electromagnetic-noise shield plate 28 beneath which the branch controller 10 is arranged so that the branch controller 10 is protected against the electromagnetic noise generated by the operation of the interrupter 2 or by the high-voltage portions. Since the actuator device 9, the detectors and so forth are arranged along a circumferential line about the longitudinal axis of the electrically grounded cover 1, the space in the cover 1 is fully utilized to receive the actuator device 9, the detectors and so forth and the cover 1 may have a cylindrical shape.

If the inside of the cover 1 is filled with an inert gas, for example $SF_6$, the shape of the cover 1 may be smaller in comparison with the above-mentioned covers.

In FIGS. 8 and 9 showing the other embodiments of the present invention, both of the voltage-transformers 8*a* and 8*b* are arranged at one of the upper portion and lower portion of the cover 1, and the actuator device 9 is arranged at the other portion. Since the distances between the interrupter 2 and the cover bushings 7*a*, 7*b* are short, the shape of the cover 1 is slender.

Figure 10:
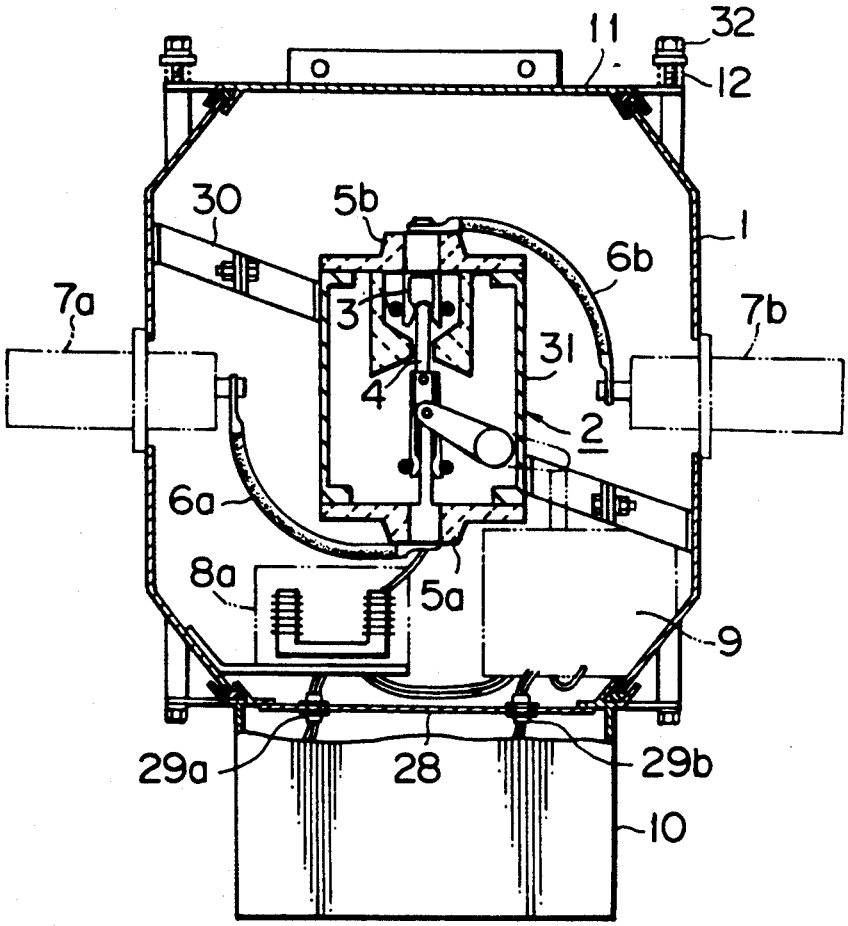
FIG. 10 is a partial cross-sectional view showing another embodiment of the interrupter unit of the present invention requiring only one voltage-transformer.
Figure 11:
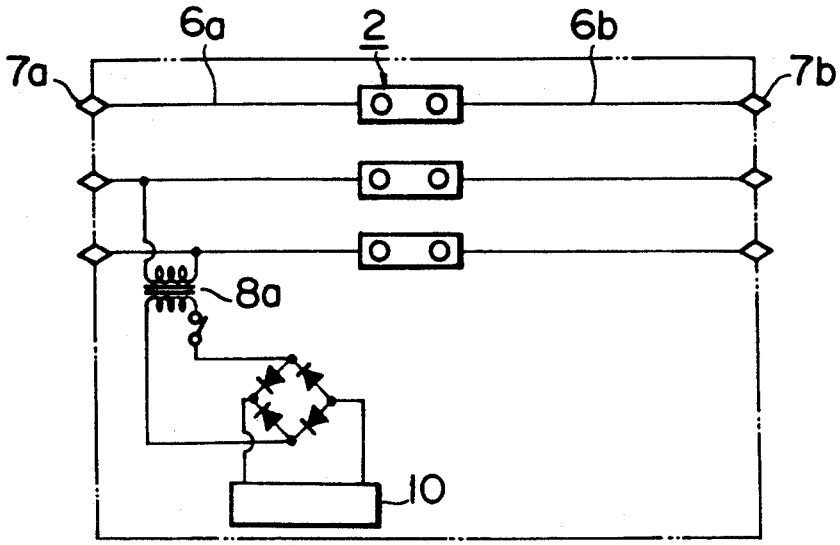
FIG. 11 is a diagram showing the electric circuit used in the interrupter unit shown in FIG. 10.

If the electricity is supplied only to the cover bushings 7*a* in every condition in the embodiment of the present invention, only the voltage-transformer 8*a* is incorporated in the interrupter unit, as shown in FIG. 10. FIG. 11 shows an electric circuit used in the embodiment shown in FIG. 10.

Figure 12:
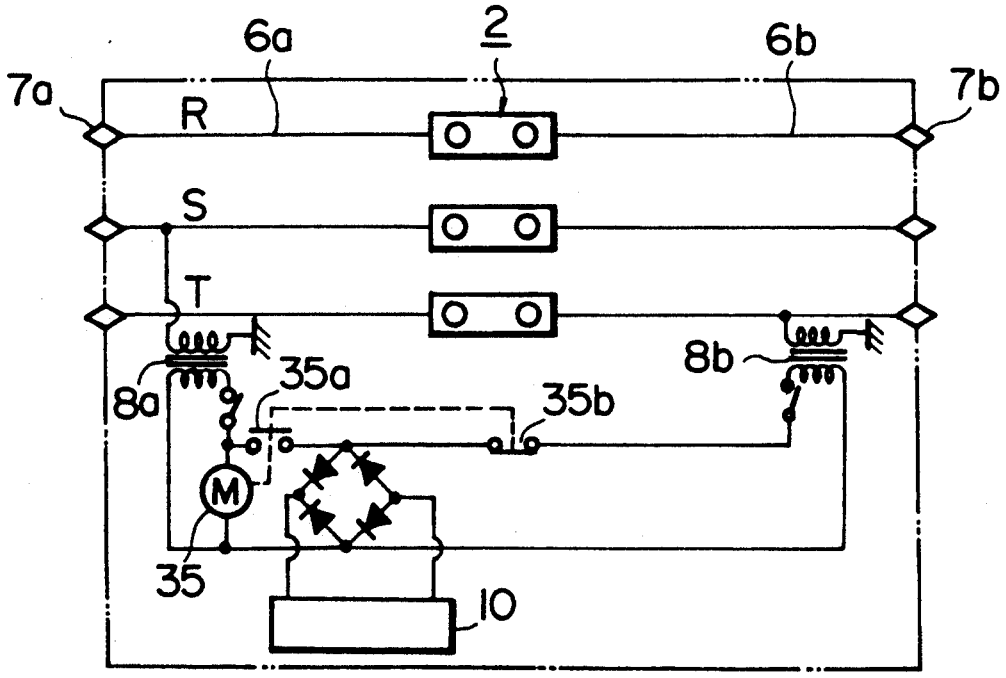
FIG. 12 is a diagram showing a modification of the electric circuit used in the interrupter unit shown in FIG. 2 wherein one of the voltage-transformer outputs is electrically connected to the cover bushings.

FIG. 12 shows a modification of the electric circuit shown in FIG. 2. One of the input terminals in each of the voltage-transformers 8*a* and 8*b* is electrically connected to one of the cover bushings 7*a* or to one of the cover bushings 7*b*, and another of the input terminals in each of the voltage-transformers 8*a* and 8*b* is electrically connected to ground.

What is claimed is:

1. An interrupter unit comprising:

an interrupter including at least two pairs of contacts and an interrupter container surrounding the pairs of contacts and being prevented from electrically communicating with the pairs of contacts, each of the pairs of contacts having a first contact and a second contact which contacts the first contact or is positioned away from the first contact so that electricity flows between the first contact and the second contact or is prevented from flowing between the first contact and the second contact;

electric actuator means for driving the pairs of contacts so that the second contacts contact the first contacts or are positioned away from the first contacts; and at least one voltage-transformer which transforms an input voltage and supplies a suitably transformed voltage to the electric actuator means so that the electric actuator means drives the pairs of contacts;

wherein the interrupter unit further comprises:

an electrically grounded cover surrounding the interrupter and having first cover terminals which are electrically connected to the first contacts, respectively, and which are prevented from electrically communicating with the grounded cover, and second cover terminals which are electrically connected to the second contacts, respectively, and which are prevented from electrically communicating with the grounded cover;

wherein the electric actuator means and the voltage-transformer are located in a space formed between the electrically grounded cover and the interrupter, the voltage-transformer being electrically connected to at least one of the cover terminals of the electrically grounded cover to receive the input voltage; and wherein the interrupter container is electrically grounded.

2. An interrupter unit according to claim 1, wherein an axis extending between the cover terminals in each of the pairs of the cover terminals is substantially perpendicular to axes of the interrupter along which the pairs of contacts are driven.

3. An interrupter unit according to claim 1, wherein a branch controller for operating the electric actuator means is arranged outside the electrically grounded cover, and an electro-magnetic-noise shield plate is arranged between the electrically grounded cover and the branch controller.

4. An interrupter unit according to claim 1, wherein the electric actuator means includes a plunger for operating the interrupter and an electromagnetic coil for driving the plunger, the electromagnetic coil being integral with the voltage-transformer.

5. An interrupter unit according to claim 1, wherein the voltage-transformer includes means for decreasing a number of energized turns of an output coil of the voltage-transformer when a current continuously flows in the output coil.

* * * * *